US006550226B1

(12) United States Patent
Gates et al.

(10) Patent No.: US 6,550,226 B1
(45) Date of Patent: Apr. 22, 2003

(54) BAG FILLING AND SEALING MACHINE AND METHOD FOR HANDLING BAGS

(75) Inventors: George C. Gates, Alliance, OH (US); Rod S. Gates, Alliance, OH (US)

(73) Assignee: Gates Automation, Inc., Sebring, OH (US)

( * ) Notice: Subject to any disclaimer, the term of this patent is extended or adjusted under 35 U.S.C. 154(b) by 82 days.

(21) Appl. No.: 09/698,830

(22) Filed: Oct. 27, 2000

Related U.S. Application Data

(60) Provisional application No. 60/161,772, filed on Oct. 27, 1999.

(51) Int. Cl.[7] ..... B65B 43/26

(52) U.S. Cl. ..... 53/459; 53/469; 53/479; 53/573; 53/284.7; 53/385.1

(58) Field of Search ..... 53/459, 468, 469, 53/479, 492, 570–573, 284.7, 385.1

(56) References Cited

U.S. PATENT DOCUMENTS

| | | | | |
|---|---|---|---|---|
| 1,007,918 | A | | 11/1911 | Chambers |
| 2,329,360 | A | | 9/1943 | Salfisberg |
| 2,999,627 | A | | 9/1961 | Reinhardt |
| 3,008,837 | A | | 11/1961 | Kaplan |
| 3,155,282 | A | | 11/1964 | Leblanc |
| 3,342,326 | A | | 9/1967 | Zackheim |
| 3,372,857 | A | | 3/1968 | Brayla |
| 3,625,351 | A | | 12/1971 | Eisenberg |
| 3,768,725 | A | | 10/1973 | Pilaro |
| 3,799,914 | A | | 3/1974 | Schmit et al. |
| 3,938,299 | A | | 2/1976 | Lerner |
| 3,948,015 | A | | 4/1976 | Lerner |
| 3,956,866 | A | | 5/1976 | Lattur |
| 3,980,225 | A | | 9/1976 | Kan |
| 3,983,994 | A | | 10/1976 | Wylotsky |
| 4,014,154 | A | | 3/1977 | Lerner |
| 4,041,846 | A | | 8/1977 | Lerner |
| 4,078,358 | A | * | 3/1978 | Henderson ..... 53/459 |

(List continued on next page.)

*Primary Examiner*—Stephen F. Gerrity
(74) *Attorney, Agent, or Firm*—Sand & Sebolt

(57) ABSTRACT

A bag filling and sealing machine includes a bag holder, a bag opening and filling station, and a sealing station. The bag holder holds wicketed bags in a manner that allows the bags to be easily torn from the holder. A funnel assembly successively opens each bag, tears the bag from the bag holder, fills the bag with material, and releases the bag to a grabber assembly. The grabber assembly engages the sides of the bag while the bag is attached to a funnel assembly and later pulls the sides of the bag away from each other so that the top of the bag is closed and ready to seal when the bag is delivered to a sealing apparatus. The grabber assembly moves in a manner so as to minimize the lost height when moving from the filling station to the sealing station.

32 Claims, 13 Drawing Sheets

U.S. PATENT DOCUMENTS 4,095,723 A 6/1978 Lerner
4,176,567 A 12/1979 Weisberg
4,201,029 A 5/1980 Lerner et al.
4,202,153 A 5/1980 Lerner et al.
4,247,019 A 1/1981 Lerner
4,263,768 A 4/1981 Russell et al.
4,337,058 A 6/1982 Lerner
4,344,557 A 8/1982 Lerner
4,350,243 A 9/1982 Weyandt
4,354,618 A 10/1982 Weyandt
4,382,527 A 5/1983 Lerner
4,387,550 A 6/1983 Lerner
4,392,056 A 7/1983 Weyandt
4,401,213 A 8/1983 Lerner
4,412,876 A 11/1983 Lerner et al.
4,432,186 A * 2/1984 McGregor ..... 53/573
4,467,207 A 8/1984 Lerner et al.
4,565,592 A 1/1986 Wehrmann et al.
4,575,901 A 3/1986 Lerner
4,589,165 A 5/1986 Lerner et al.
4,598,826 A 7/1986 Shinbach
4,613,320 A 9/1986 Lerner
4,620,888 A 11/1986 Easter et al.
4,651,506 A 3/1987 Lerner et al.
4,680,205 A 7/1987 Lerner et al.
4,726,170 A * 2/1988 Sawa et al. ..... 53/468
4,745,658 A 5/1988 Lerner
RE32,963 E 6/1989 Lerner et al.
4,899,520 A 2/1990 Lerner et al.
4,901,506 A 2/1990 Weyandt
4,914,895 A * 4/1990 Kuckhermann et al. ..... 53/573
4,926,048 A 5/1990 Lerner et al.
4,928,455 A 5/1990 Gereby et al.
4,944,825 A 7/1990 Gifford et al.
4,945,252 A 7/1990 Lerner et al.
4,961,503 A 10/1990 Bell
4,969,310 A 11/1990 Lerner et al.
5,041,148 A 8/1991 Gereby et al.
5,046,621 A 9/1991 Bell
5,057,824 A 10/1991 Stokes
5,059,114 A 10/1991 Stout et al.
5,070,674 A 12/1991 Lerner et al.
5,077,958 A 1/1992 Peppard et al.
5,134,833 A 8/1992 Lerner et al.
5,174,449 A 12/1992 Ball
5,232,541 A 8/1993 Gifford
5,259,172 A 11/1993 Peppard et al.
5,265,402 A 11/1993 Lerner et al.
5,289,671 A 3/1994 Lerner et al.
5,301,889 A 4/1994 Ball
5,304,264 A 4/1994 Wehrmann
5,310,056 A 5/1994 Ball
5,341,625 A 8/1994 Kramer
5,371,521 A 12/1994 Wehrmann
5,394,674 A 3/1995 Peppard et al.
5,394,676 A 3/1995 Lerner et al.
5,411,627 A 5/1995 Lerner et al.
5,417,639 A 5/1995 Cronauer
5,426,918 A 6/1995 Ball
5,435,114 A * 7/1995 Moehlenbrock et al. ..... 53/469
5,470,419 A 11/1995 Sasaki et al.
5,474,208 A 12/1995 Ball
5,499,485 A 3/1996 Lerner et al.
5,535,792 A * 7/1996 McGregor ..... 53/573
5,568,718 A 10/1996 Lerner et al.
5,570,568 A 11/1996 Kramer
5,586,708 A 12/1996 Lerner et al.
5,600,360 A 2/1997 Lerner et al.
5,619,839 A 4/1997 Peppard et al.
5,626,004 A 5/1997 Gates et al.
5,640,834 A 6/1997 Lerner et al.
5,671,787 A 9/1997 Wehrmann
5,709,069 A 1/1998 Cronauer
5,722,218 A 3/1998 Lerner
5,743,070 A 4/1998 Lerner et al.
5,771,667 A * 6/1998 McGregor et al. ..... 53/469
5,772,565 A 6/1998 Weyandt
5,806,276 A 9/1998 Lerner et al.
5,878,553 A * 3/1999 Schlosser ..... 53/469
5,887,412 A 3/1999 Lerner et al.
5,890,346 A 4/1999 Guess
5,915,555 A 6/1999 Ball
5,944,424 A 8/1999 Lerner et al.
5,945,252 A 8/1999 Sokoluk et al.
5,957,824 A 9/1999 Lerner et al.
5,987,856 A 11/1999 Lerner
5,996,319 A 12/1999 Lerner et al.
6,035,611 A 3/2000 Lerner
6,055,796 A 5/2000 Lerner et al.
RE36,759 E 7/2000 Hoover et al.
6,134,864 A * 10/2000 McGregor et al. ..... 53/459
6,169,349 B1 1/2001 Davenport
6,170,238 B1 1/2001 Lerner
6,199,349 B1 3/2001 Lerner

* cited by examiner

BAG FILLING AND SEALING MACHINE AND METHOD FOR HANDLING BAGS

CROSS REFERENCE TO RELATED APPLICATIONS

This application claims priority from U.S. Provisional Patent Application serial No. 60/161,772 filed Oct. 27, 1999; the disclosures of which are incorporated herein by reference.

BACKGROUND OF THE INVENTION

1. Technical Field

The present invention generally relates to packaging equipment and, more particularly, to machinery that fills and seals plastic bags. Specifically, the present invention is directed to a bag handling machine that automatically opens, fills, and seals wicketed plastic bags for the food industry. The application also relates to methods for handling the bags as the bags are being opened, filled, and sealed.

2. Background Information

Packaging various items in plastic bags is becoming increasingly popular in the packaging and food packaging industry. Plastic bags are inexpensive to manufacture and have the ability to keep food fresher than other types of traditional packaging. Some types of plastic bags may include a resealable closure. Problems have occurred in the food industry in filling these bags leading some packaging companies to fill the bags by hand. Filling bags by hand is expensive and increases the probability of food contamination.

It is desired in the art to provide an automated machine that fills plastic bags with food items and seals the plastic bag in a sanitary environment. Such machines are governed by numerous governmental restrictions relevant to food handling. For instance, all food handling equipment must be disposed a minimum distance above any floor surface. Any food that is dropped onto the ground obviously must be discarded for sanitary purposes. Various other limitations known in the art govern the design of this type of automated equipment. The limitation regarding the height of the food items above the floor increases the importance of the height of the apparatus and the loss of height that occurs during the process performed by the apparatus. This importance is magnified when the machine is installed in a building with a low ceiling. It is thus desired in the art to provide a bag filling and sealing apparatus that performs its process while losing little vertical height in the flow of the bag. Such a machine provides maximum head room for the equipment that it is being attached to.

Other important design considerations include the desire to eliminate wasted bags, wasted food, and wasted time. As such, the machine should generally move the bags quickly through the process of filling and sealing, eliminate broken bags that must be discarded, and eliminate misfires that cause the food to be dropped onto the ground.

Another problem that has arisen with the use of bags to package food is particularly evident with bags having lower gussets that form a broad based bag. These bags are desired in the art because they may stand vertically on their own after they have been filled and can accept a relatively large amount of food in a small space and without damaging the food. Unfortunately, a rather significant amount of force is sometimes required to open the gussets to their open position. This relatively large amount of force may be easily created when the food items are relatively heavy but difficult to achieve when the food items are relatively light. Light food items may include various types of snack foods such as popcorn that occupy a large volume while weighing relatively little. It is thus desired in the art to provide an apparatus that ensures that the bottom gussets of these types of bags open prior to filling the bags with the food item.

Another problem with prior art bag filling machinery is that the wickets or bag holders used to hold the bags before they are filled often cause the bags to wrinkle and tear as they are being pulled off of the holder. Such prior art bag holders typically include a right angle junction where the bags are being pulled from the holder. It has been found that this junction tends to wrinkle the plastic of the bag at the junction and causes the corner seams of the bag to tear as the bag is being pulled from the holder.

Another problem with prior art devices is that some bags must be evacuated prior to sealing. This has created problems because the top of the bag must be substantially closed prior to evacuating the bag. It is thus desired in the art to provide a configuration that allows the bags to be easily evacuated just prior to sealing the bags.

SUMMARY OF THE INVENTION

In view of the foregoing, it is a primary aspect of the present invention to provide a bag filling and sealing machine that solves the problems experienced in prior art devices.

The invention thus provides a bag handling machine for filling material into a bag and sealing the bag; the machine including a bag holder adapted to hold the bag before the bag is filled; a bag filling station adapted to fill the bag with material; a sealing station adapted to seal the bag; and a grabber assembly adapted to move the bag from the bag filling station to the sealing station.

The invention also provides a method for filling and sealing a bag with a material, the method including the steps of (a) providing an empty collapsed bag on a bag holder; (b) removing the bag from the bag holder with a funnel assembly; (c) opening the bag with the funnel assembly; (d) filling the bag with material through the funnel assembly; (e) grasping the opposed top edges of the bag with a pair of grabber arms; (f) pulling the grasped top edges of the bag apart; (g) delivering the bag to a sealing apparatus; and (h) sealing the bag.

The invention also provides a device and method that allows bags to be easily removed from the bag holder.

The invention provides a device and method that opens the bottom gussets of a gusseted bag prior to filling the bag with material.

The invention provides a device and method that uses the funnel used to load the bag to open the bag and to tear the bag off the bag holder.

The invention provides a device and method that includes a mechanism that grabs the top edge of the bag and pulls the top of the bag shut prior to sealing the bag.

The invention provides a device and method that minimizes the lost distance when moving the bag from the filling station to the sealing station.

The invention provides a device and method wherein a flexible sealing bar at the sealing station closes the top of the bag while the bag is being evacuated prior to sealing.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended Claims.

Similar numbers refer to similar parts throughout the invention.

DESCRIPTION OF THE PREFERRED EMBODIMENTS

Figure 1:
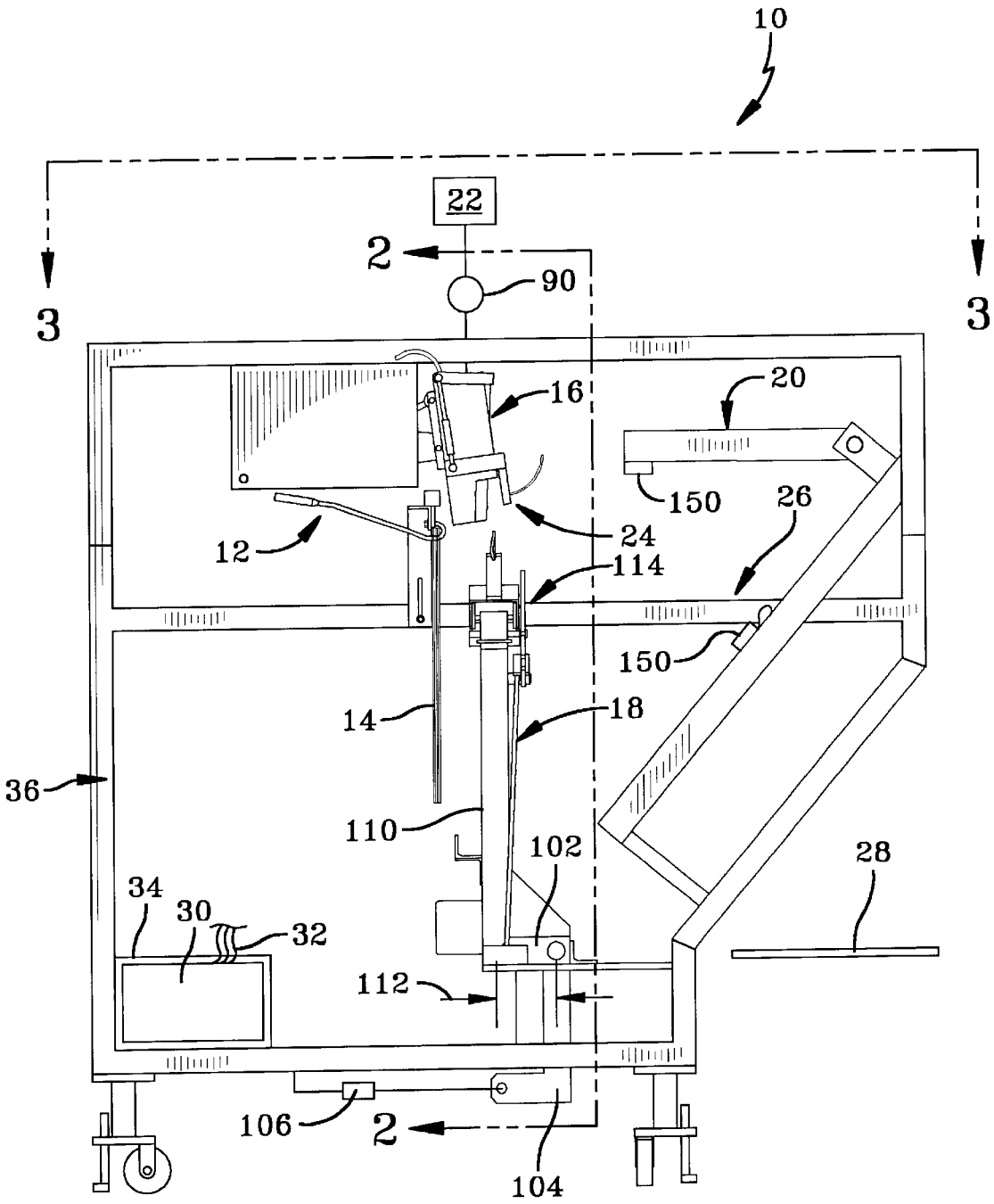
FIG. 1 is a side view of the bag filling and sealing apparatus of the present invention with various components removed in order to clearly show the relation between the primary bag filling and sealing components.

The Bag Filling and Sealing Machine is indicated generally by the numeral 10 in the accompanying drawings. Machine 10 generally includes a bag holder 12 that holds a plurality of wicketed bags 14 in a ready position. A funnel assembly 16 is positioned above bags 14 and is operable to successively open each bag 14, tear bag 14 from bag holder 12, fill bag 14 with material, and release bag 14 to a grabber assembly 18. Grabber assembly 18 engages the sides of bag 14 while bag 14 is attached to funnel assembly 16 and later pulls the sides of bag 14 away from each other so that the top of bag 14 is closed and ready to seal when bag 14 is delivered to a sealing apparatus 20. Machine 10 operates by taking an empty bag 14 from bag holder 12 and moving it to an open position with funnel assembly 16. Machine 10 first checks to be sure bag 14 is positioned on funnel assembly 16 and then delivers material from a material supply 22 (shown schematically in FIG. 1) through funnel assembly 16 and into bag 14. While this occurs, grabber assembly 18 moves into position to grasp the upper edges of the sides of bag 14 so that the, top edge of bag 14 may be pulled closed while loaded bag 14 is moved from the filling station 24 to the sealing station 26. Grabber assembly 18 moves in a manner so as to minimize the lost height when moving from filling station 24 to sealing station 26. Bag 14 is sealed at sealing station 26 and grabber assembly 18 then releases the loaded and sealed bag to a conveyor 28.

Machine 10 further includes control apparatus 30 that controls each of the components of machine 10. Control apparatus 30 includes any of a variety of computers, logic controllers, power sources, etc. that are required to drive and operate each of the mechanisms and sensors present on machine 10. Such controls and sensors are well known in the art and the programs used to operate the controls are also well known in the art. Control apparatus 30 is operatively connected to each mechanism by a plurality of wires 32 as is known in the art. Control apparatus 30 is preferably housed in a protective casing 34 that is resistant to the cleaners commonly used to clean food handling equipment. Protective casing 34 is waterproof and resistant to detergents. Protective casing 34 is preferably mounted to the frame 36 of machine 10 so that machine 10 may be readily moved from one position to another position.

Bags 14 are typically supplied to the user of machine 10 on a bag wicket (not shown) as is known in the art. Bag wickets are known in the art and include two spaced apart rods connected at one end by a connecting rod. Bags 14 include a top flange 40 having a pair of mounting holes 42 which receive the spaced apart rods of the bag wicket. A plurality of bags 14 are typically hung on a single bag wicket. Bag holder 12 is configured to receive the ends of the bag wicket in a pair of receivers 44. Each receiver 44 is an enlarged end portion of bag holder 12 having an opening that receives a free end of the bag wicket. When the bag wicket is received in receivers 44, the user of bag holder 12 pushes bags 14 from the bag wicket, over receivers 44 (which have smooth contours to facilitate the transition), and onto the sloped body rods 46 of bag holder 12. Although it is preferred that body rods 46 be sloped in the downward direction to encourage bags 14 to move toward the end of bag holder 12, rods 46 may be positioned differently (such as horizontally) in other embodiments of the invention. Rods 46 are connected at their lower ends to pull-off hooks 48.

Figure 5:
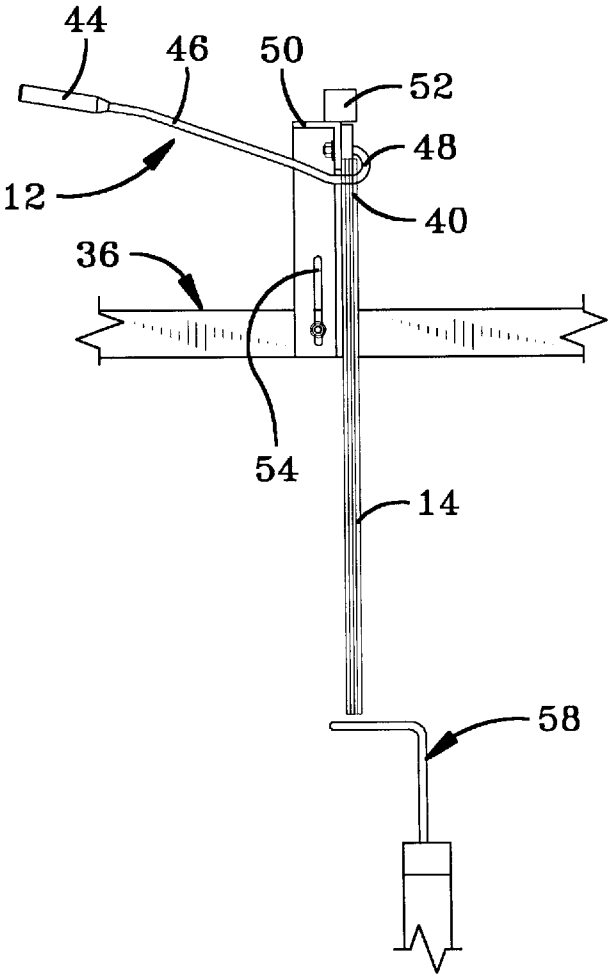
FIG. 5 is a sectional view taken along line 5—5 of FIG. 4.
Figure 4:
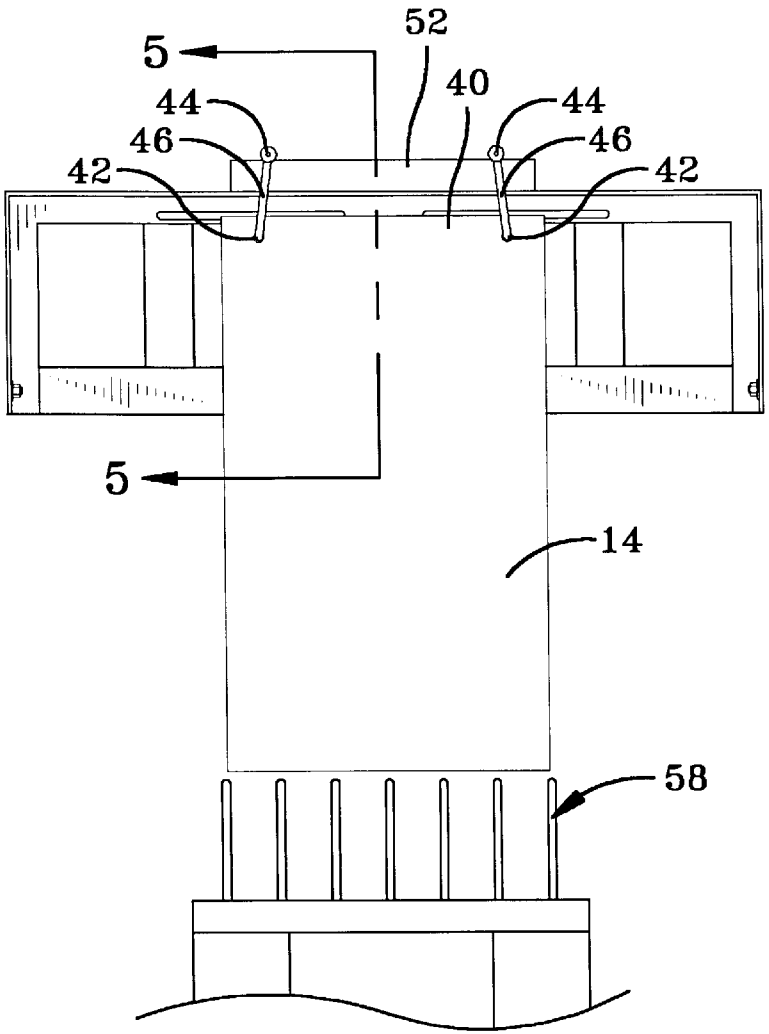
FIG. 4 is a rear elevational view of the bag holder apparatus showing a plurality of bags held on the bag holder.

Each pull-off hook 48 is connected to a frame member, such as frame member 50 depicted in FIG. 5, in an adjustable manner so that rods 46 may be readily adjusted to be used with different-sized bags. In the preferred embodiment, hooks 48 connect to frame member 50 in a selective sliding arrangement with clamp bolts to hold hooks 48 in place. Hook 48 extends from the front surface of frame member 50, turns downwardly and back under frame member 50 and connects with the lower end of rod 46. This configuration ensures that bag 14 will only engage rod 46 or hook 48 as it is being pulled from bag holder 12. In most situations, bag 14 will be pulled from the curved portion of hook 48 and will be completely free of frame member 50. This configuration allows bags 14 to be pulled smoothly from bag holder 12 without damaging bags 14. Hooks 48 are fabricated with a round or curved cross section so that bags 14 may be easily pulled over hooks 48 as they are being removed from bag holder 12. The curved configuration ensures that there is no pinching or snagging of bag 14 on hook 48.

The arrangement of hooks 48 in front of frame member 50 and in front of the connection of bag holder 12 to frame member 50 also allows bags 14 to be more readily presented to funnel assembly 16. The forward position allows funnel assembly 16 to be more easily positioned within each bag 14 as will be described below. The forward position of bags 14 also allows an air knife 52 to be positioned to initially blow open the next bag 14 to be filled by machine 10. Air knife 52 is positioned to blow a stream of air down along the forward facing surface of top flange 40 and into the upper opening of bag 14. This action initially opens bag 14 so that funnel assembly 16 may be inserted into bag 14 as described below.

The position of bag holder 12 may be readily adjusted with respect to funnel assembly 16. For instance, frame member 50 may be provided with slots 54 as depicted in FIG. 5 that allow the height of bag holder 12 to be readily adjusted. Similarly, the mounting between funnel assembly 16 and frame 36 may be adjustable so that the lateral and longitudinal position of funnel assembly 16 may be readily adjusted with respect to bag holder 12. These adjustments allow the tops of bags 14 to be precisely located with respect to the nose 56 of funnel assembly 16.

A lower support structure 58 is adjustably connected to frame 36 and positioned below funnel assembly 16. Structure 58 provides support to the bottoms of bags 14 while they are being filled and transported through machine 10. It is preferred that structure 58 be mounted to grabber assembly 18 and move with grabber assembly 18 so that bag 14 is continuously supported while it travels through machine 10.

Figure 1A:
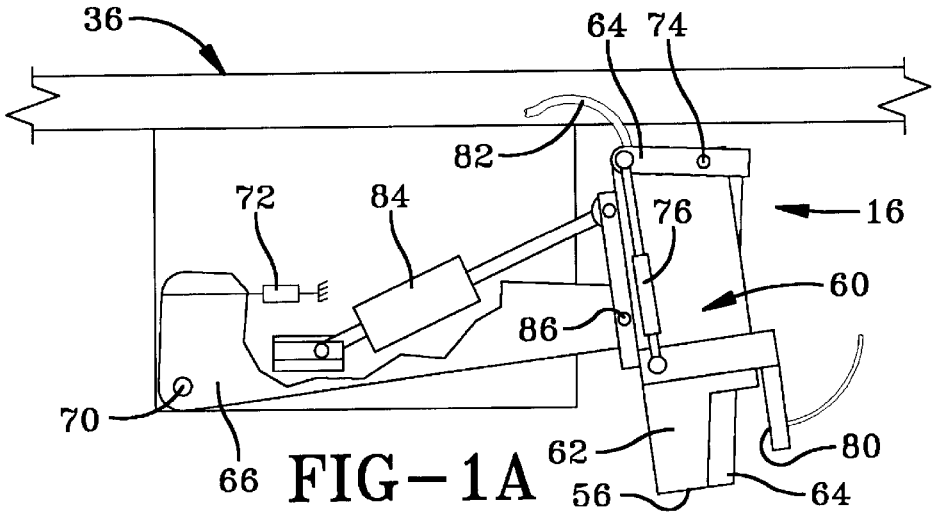
FIG. 1A is an enlarged side view (with portions broken away for clarity) of the funnel assembly in a first position.
Figure 1B:
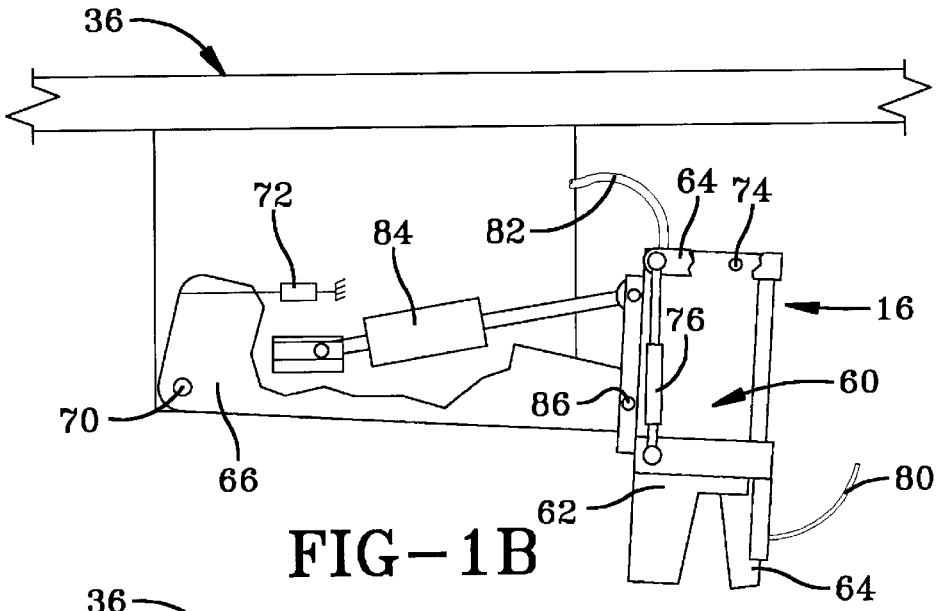
FIG. 1B is an enlarged side view (with portions broken away for clarity) of the funnel assembly in a third position.
Figure 1C:
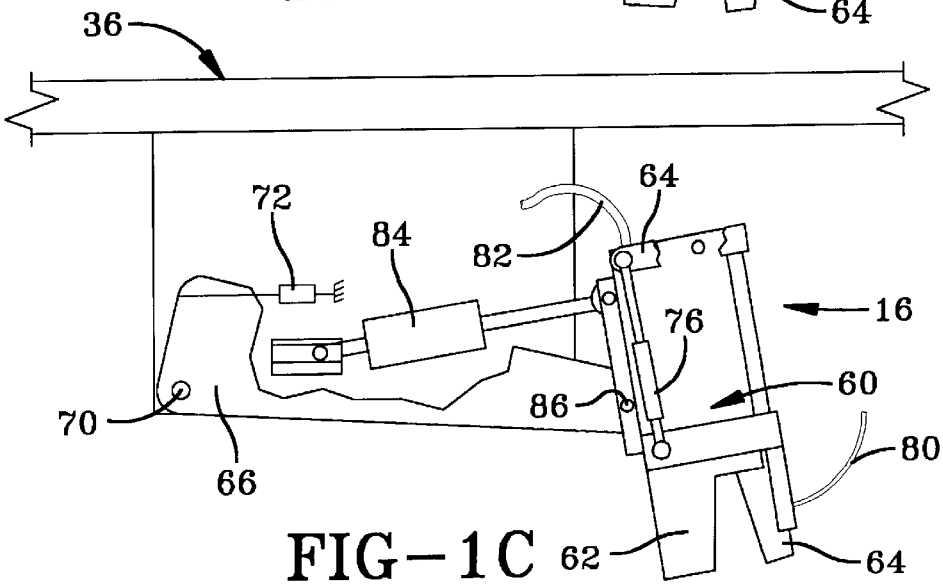
FIG. 1C is an enlarged side view (with portions broken away for clarity) of the funnel assembly in a fourth position.

Funnel assembly 16 includes a funnel 60 having a fixed first half 62 and a moveable second half 64 (FIGS. 1A–1C). Halves 62 and 64 are mounted on a funnel frame 66 that is moveably mounted to frame 36. Funnel frame 66 is pivotally connected to frame 36 at pivot 70. An actuator 72 extends between frame 36 and funnel frame 66 to selectively pivot funnel frame 66 about pivot 70. Extension of actuator 72 moves funnel assembly 16 from the first position depicted in FIGS. 1A and 6 to the second position depicted in FIGS. 1B,C and 8. Extension and retraction of actuator 72 moves funnel assembly 16 up and down with respect to frame 36.

Moveable second half 64 is pivotally attached to fixed first half 62 at pivot 74 so that second half 64 may pivot with respect to first half 62 between open and closed positions. When second half 64 is in the closed position, nose 56 is formed. Actuators 76 selectively control the movement of second half 64 with respect to first half 62. Actuators 76 are positioned on either side of funnel 60 to provide smooth consistent movement to funnel 60.

A bag check sensor 80 is positioned so that second half 64 engages sensor 80 when second half 64 is in the open position as depicted in FIGS. 1B,C and 10. Sensor 80 is configured to sense the presence of bag 14 on funnel 60. If bag 14 is properly positioned on funnel 60, sensor 80 sends one signal and sends a different signal if it fails to sense bag 14. Sensor 80 thus prevents material from being supplied to funnel 60 without bag 14 being properly positioned on funnel 60. Any of a variety of sensors 80 may be used to provide this function.

Figure 10:
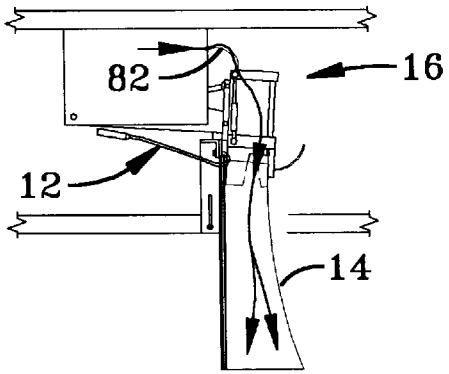
FIG. 10 is a view similar to FIG. 9 showing an option wherein a blast of air is blown into the bag to open the lower gussets in a gusseted bag.

Funnel assembly 16 may optionally include an air supply line 82 disposed to allow the user of machine 10 to selectively blow air into bags 14 as depicted in FIG. 10. Air supply line 82 is particularly useful for blowing open the lower gussets of gusseted bags so that the gusseted bags may be filled with a relatively light-weight material.

A second actuator 84 is disposed between fixed first half 62 and frame 36 to selectively pivot funnel 60 about pivot point 86.

Figure 8:
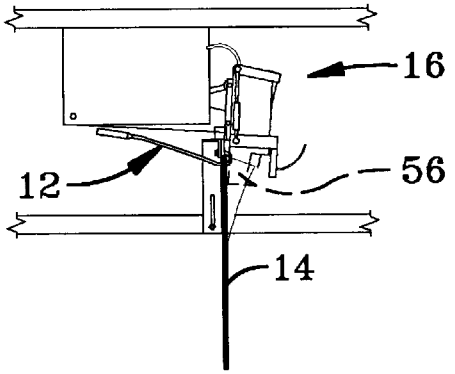
FIG. 8 is a side view of the funnel assembly in a second position wherein the nose of the funnel assembly is inserted into the bag that was blown open in FIG. 7.
Figure 7:
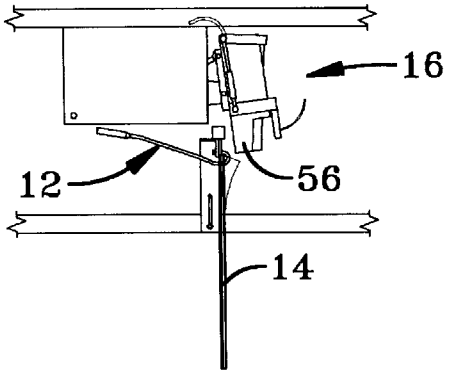
FIG. 7 is a side view of the funnel assembly showing air being blown into a bag to initially open the bag for funnel insertion.
Figure 6:
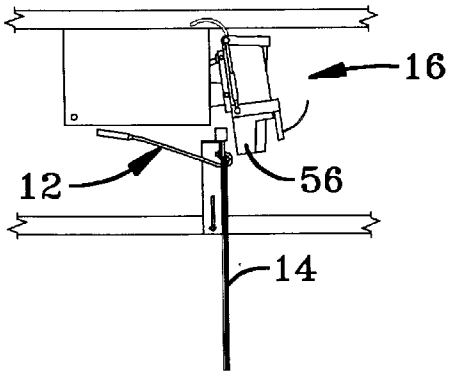
FIG. 6 is a side view of the funnel assembly with the funnel assembly in a first position.
Figure 9:
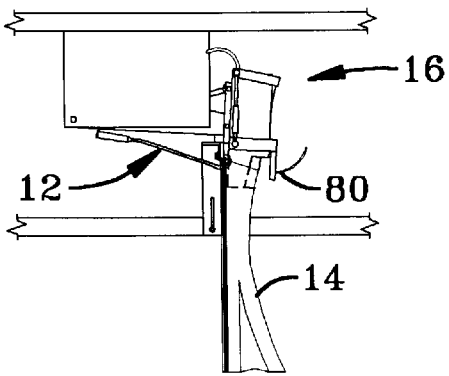
FIG. 9 is a side view of the funnel assembly in a third position wherein the funnel has moved to an open position to open the top of the bag.

Funnel assembly 16 functions to remove a bag 14 by performing the steps depicted in FIGS. 6–11. In FIG. 6, funnel assembly 16 is in the first position and bag 14 is hanging on bag holder 12. Air knife 52 provides a flow of air to initially open bag 14 as depicted in FIG. 7. Actuator 72 is then utilized to move nose 56 of funnel 60 into the open portion of bag 14 as depicted in FIG. 8. Bag 14 is then opened when funnel 60 is moved to the open position by actuators 76. This position is the third position of funnel assembly 16 and is depicted in FIG. 9. In this position, a portion of bag 14 is driven against sensor 80 to create a signal to control apparatus 30 that a bag 14 is properly positioned on funnel 60. Funnel assembly 16 may optionally include an air supply line 82 disposed to allow the user of machine 10 to selectively blow air into bags 14 as depicted in FIG. 10. Air supply line 82 is particularly useful for blowing open the lower gussets of gusseted bags so that the gusseted bags may be filled with a relatively light-weight material.

Figure 11:
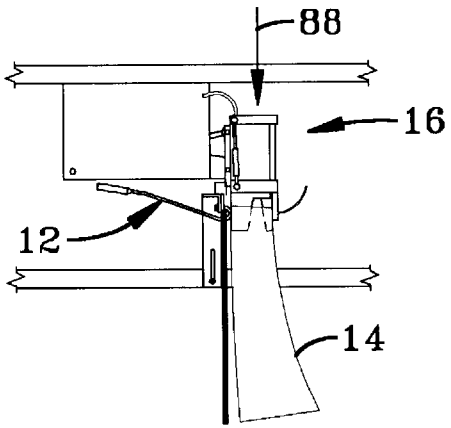
FIG. 11 is a side view of the funnel assembly in a fourth position wherein the open funnel has moved forward to tear the bag from the bag holder.

When the signal from sensor 80 registers, funnel 60 is urged forward to its fourth position where it tears bag 14 away from hooks 48. This position is to depicted in FIG. 11. The forward tilting motion is created by actuator 84 which pivots funnel 60 about pivot point 86. Food items 88 may then be loaded through funnel 60 into bag 14 as depicted in FIG. 11. Control apparatus 30 may control a valve 90 positioned in cooperation with material supply 22 to selectively supply items 88 to bag 14. It should be noted that although food items are provided as a preferred embodiment, other items may be used with machine 10 without departing from the concepts of the present invention.

After funnel assembly 16 is open and the top of bag 14 is open, grabber assembly 18 moves in toward bag 14 and engages the top of the sides of bag 14 to support bag 14 when funnel 60 is removed from bag 14. Grabber assembly 18 then rotates to pivot bag 14 from filling station 24 to sealing station 26 as shown in FIGS. 12–24.

Grabber assembly 18 includes a common drive rod 100 that is pivotally connected to frame 36 by a pair of bearing blocks 102. A drive arm 104 extends down from drive rod 100 and is positioned substantially centrally along drive rod 100 so that movement of drive arm 104 smoothly rotates drive rod 100. Drive arm 104 is connected to a grabber assembly actuator 106 that extends between drive arm 104 and frame 36. Actuator 106 is selectively extendable and retractable to selectively rotate grabber assembly 18 about the axis of drive rod 100.

Grabber arms 110 extend up from both ends of drive rod 100 to positions on either side of funnel assembly 16. The lower end of each arm 110 is connected to drive rod 100 at a position rearwardly offset from the pivot axis of drive rod 100. This offset may be seen in FIG. 1 and is indicated by the dimension line 112. Offset 112 minimizes the height loss of grabber assembly 18 when it pivots from filling station 24 to sealing station 26. Offset 112 minimizes the height loss by actually raising arms 110 with respect to the pivot axis of drive rod 100 as grabber assembly 18 initially rotates from filling station 24 toward sealing station 26.

A grabber 114 is mounted at the top of each arm 110. Grabber 114 is configured to move inwardly in an arcing motion to grab the upper surface of bag 14. Grabbers 114 are constructed to move in a motion that simulates a motion that a human arm would follow when grabbing the top of the sides of a bag. As such, grabber 114 moves up, over and down onto bag 14 as it performs this motion. By moving down onto the top of bag 14, grabber 114 is less likely to miss bag 14 or tear bag 14.

Each grabber 114 includes a base 116 upon which a stationary cam 118 and rotary actuator 120 are mounted. Stationary cam 118 is a fixed member having a longitudinal slot that is substantially parallel to base 116. Rotary actuator 120 is selectively controlled by control apparatus 30 to rotate a drive arm 122 about a pivot axis 124. The outer end of drive arm 122 is connected to a hand assembly 126 that includes a finger assembly. 128 mounted at its inner end. Hand assembly 126 is pivotally connected to drive arm 122 and slidably connected to stationary cam 118 with a cam follower 130. Hand assembly 126 is thus moved in toward bag 14 by rotating drive arm 122 with rotary actuator 120 toward bag 14. Hand assembly 126 is moved away from bag 14 by rotating drive arm 122 with rotary actuator 120 away from bag 14. When drive arm 122 is rotated, hand assembly 126 pivots about pivot 124 and slides along stationary cam 118. This motion produces an up, in and down motion as hand assembly moves in and then up, out and down motion as hand assembly moves out away from bag 14.

Figure 17:
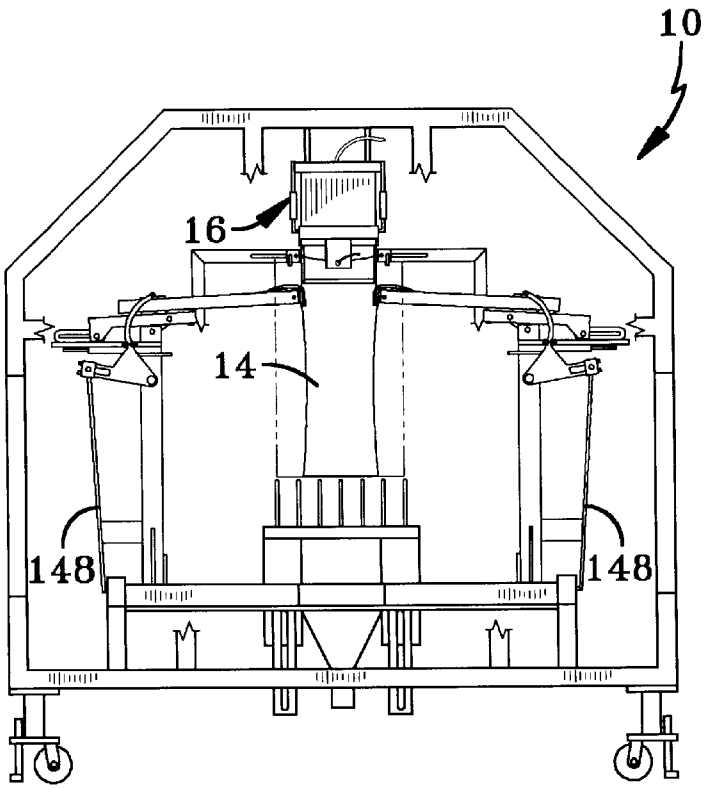
FIG. 17 is a view taken along line 17—17 of FIG. 16.
Figure 16:
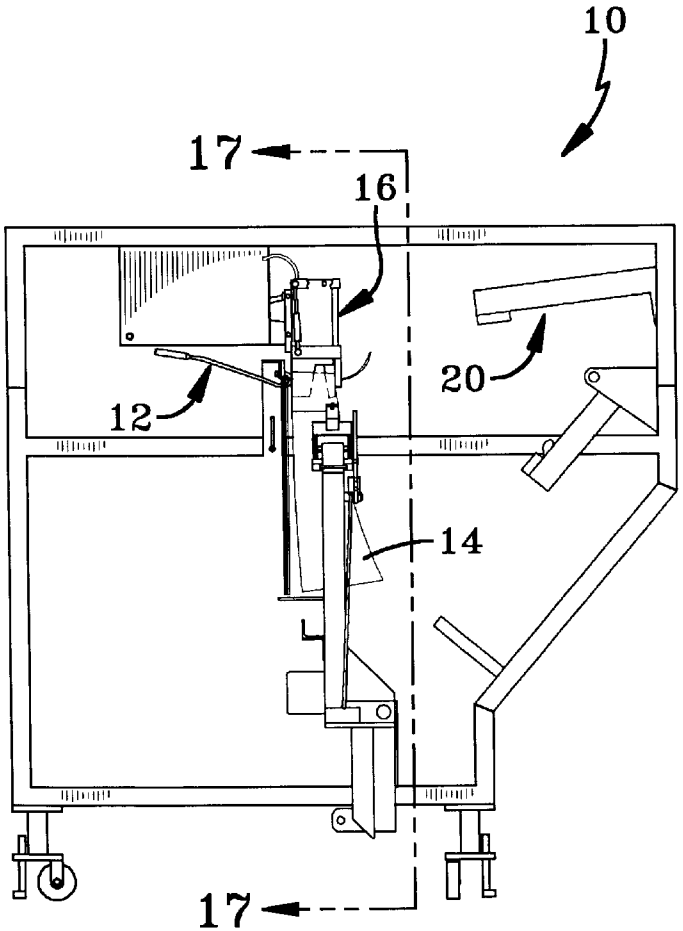
FIG. 16 is a view similar to FIG. 12 showing the grabber assembly in the third position.

The motion of hand assembly 126 positions finger assembly 128 over the top edges of bag 14 as depicted in FIGS. 16 and 17. By moving finger assembly 128 down over the top of bag 14, it is less likely that finger 128 will catch on the side of the bag and miss its connection. This feature allows machine 10 to properly function even when the vertical height of bags 14 is not perfectly aligned with respect to hand assemblies 126.

Figure 2:
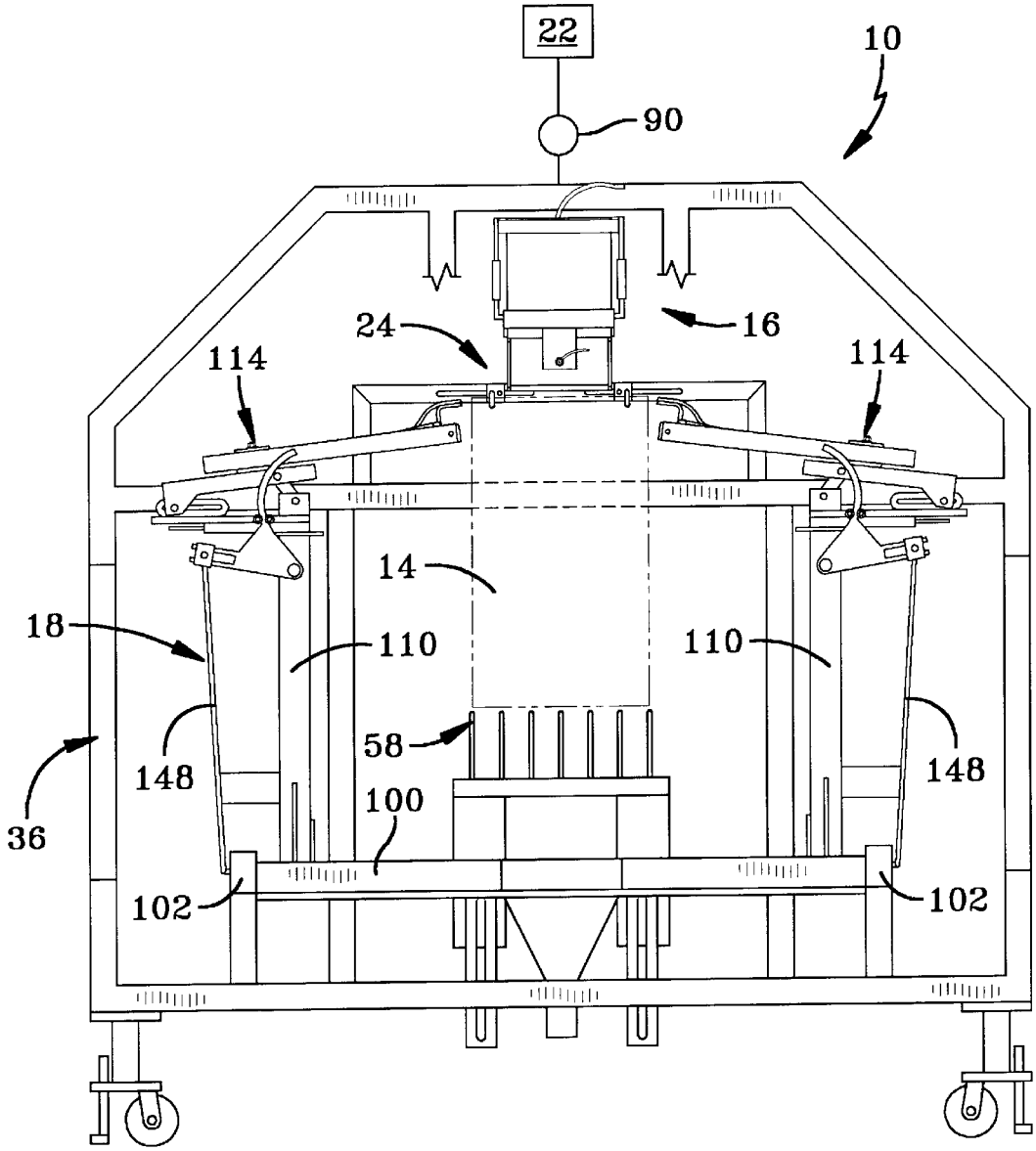
FIG. 2 is a sectional view taken along line 2—2 of FIG. 1.
Figure 2A:
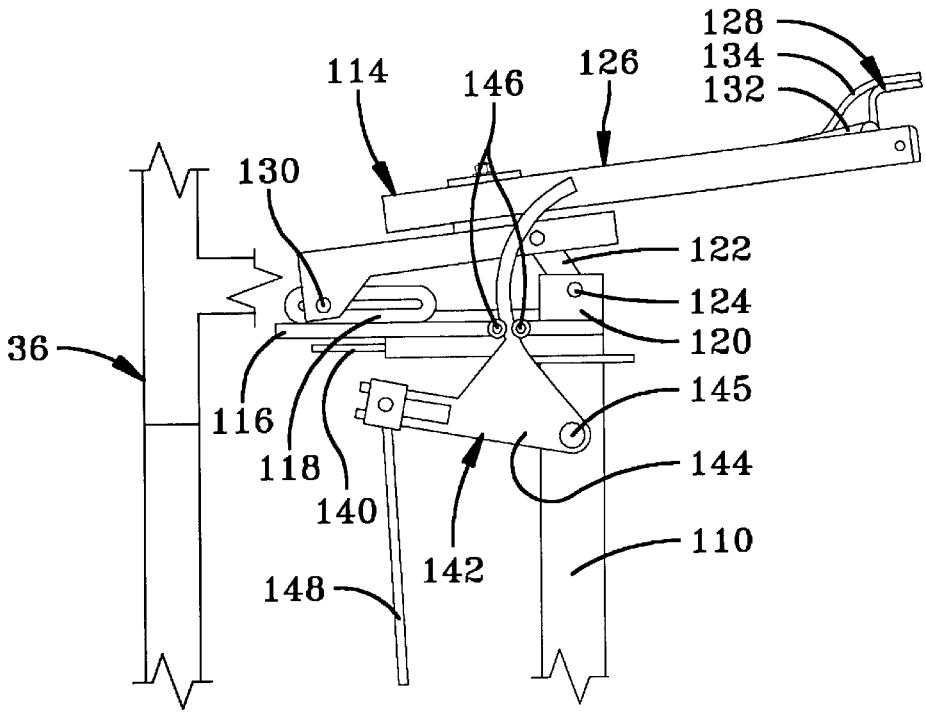
FIG. 2A is an enlarged front elevational view of the grabber in a retracted position.
Figure 2B:
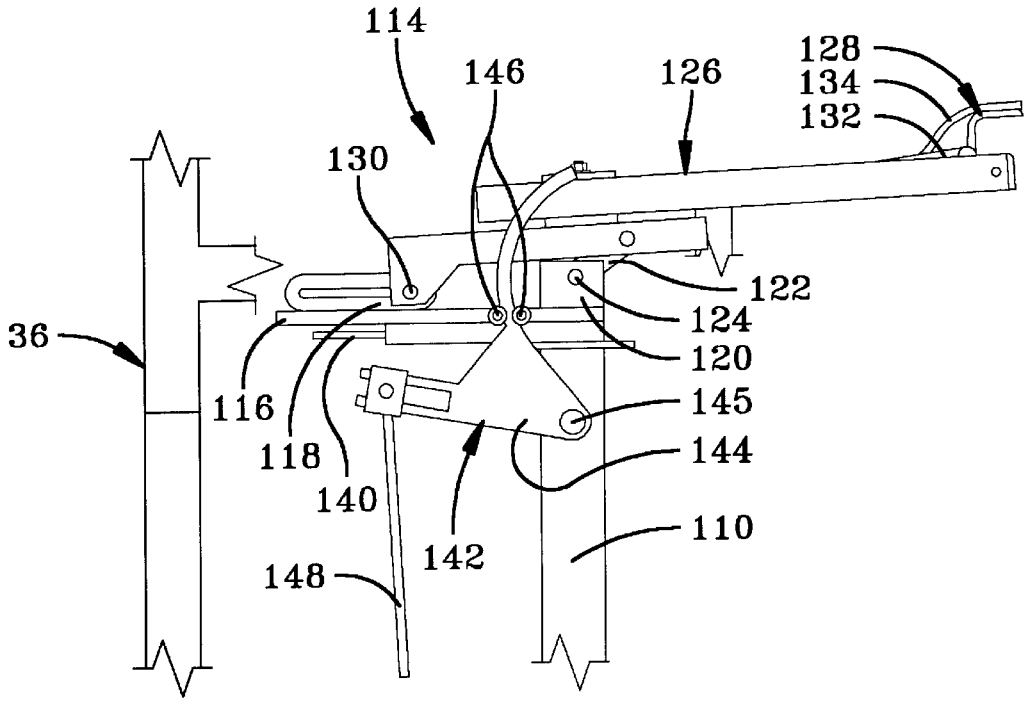
FIG. 2B is an enlarged front elevational view of the grabber in an extended position.
Figure 3:
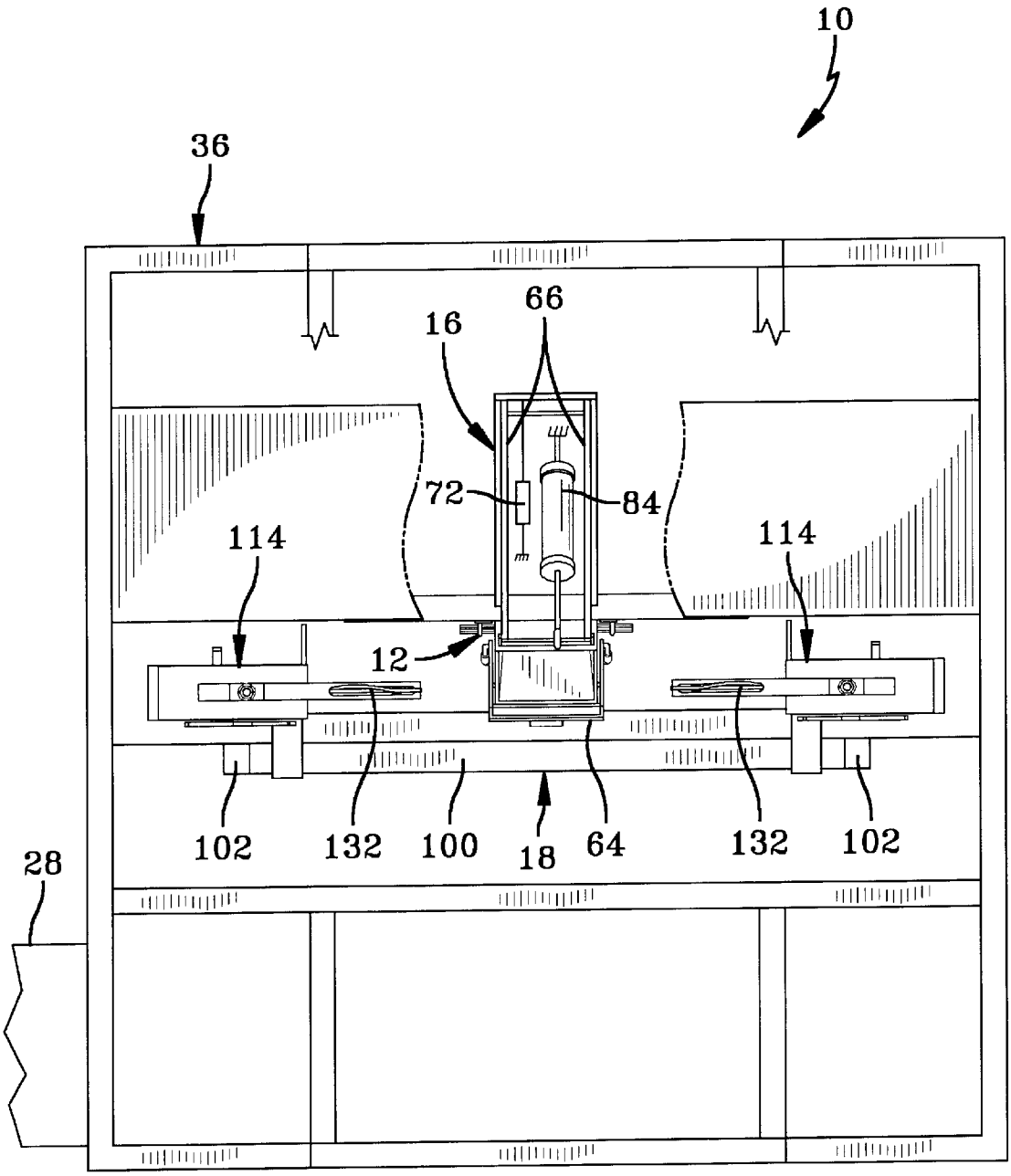
FIG. 3 is a top view taken along line 3—3 of FIG. 1.

Finger assembly 128 is pivotally connected to the end of hand assembly 126 and is driven between a first position depicted in FIG. 2 and a second position depicted in FIG. 17 by a finger assembly actuator 132. Finger assembly 128 may include an optional air line 134 that may be used to insert a gas or a fluid into bag 14 after it has been filled. Air line 134 may also be used to evacuate bag 14.

Each hand assembly 126 is slidably mounted with respect to arm 110 so that it may move in and out with respect to bag 14 without moving actuator 120. The sliding connection is accomplished by slidably mounting base 116 on a slide rod 140. Base 116 is driven back and forth on slide rod 140 by cam assembly 142. Cam assembly 142 functions to move base 116 out away from bag 14 as grabber assembly 18 pivots from filling station 24 toward sealing station 26. Cam assembly 142 thus automatically pulls fingers 128 away from each other thus closing the top of bag 14 during the natural movement of bag 14 from filling station 24 to sealing station 26.

Cam assembly 142 includes a cam 144 pivotally mounted at pivot 145 to arm 110. Cam 144 is preferably an elongated curved cam that provides a smooth motion to hand assemblies 126 as they move. As can be seen in the drawings, cam 144 is concave when viewed from the position of bag 14. In other embodiments of the invention, cam 144 may be configured in a different manner to provide different motion to hand assemblies 126.

A pair of cam followers 146 are positioned on either side of cam 144. Each cam follower 146 is connected to base 116 with a rotating connection that allows cam followers 146 to rotate with respect to base 116 and cam 144. Cam followers 146 snugly engage cam 144 so as to immediately transmit the motion of cam 144 to base 116.

A cam rod 148 connects one end of cam 144 to a fixed ground point. The fixed ground point is spaced from the pivot axis of common drive rod 100 and fixed to frame 36. Thus, the pivoting motion of grabber assembly 18 causes rods 148 to pivot about their fixed ground points. The exact location of the fixed ground point may be adjusted with respect to frame 36 in order to vary the motion created by cam assembly 142. This motion causes cam 144 to move with respect to base 116 driving base 116 (and thus hand assembly 126) back and forth along slide rod 140. Cam assemblies 142 and hand assemblies 126 are arranged to move away from bag 14 when grabber assembly 18 pivots from filling station 24 toward sealing station 26 as shown in FIGS. 12 through 23. This motion causes finger assemblies 128 to pull the top of bag 14 closed so that it may be sealed as shown in FIGS. 12 through 23.

Figure 24:
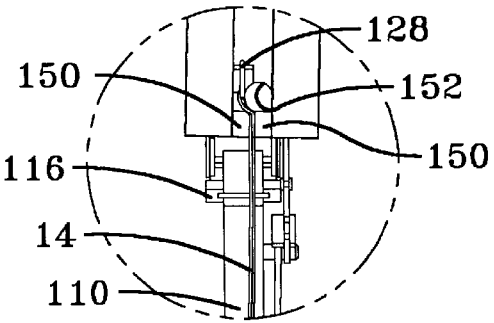
FIG. 24 is an enlarged view of the encircled portion of FIG. 23 taken from the side showing the pinch plate and sealing apparatus.
Figure 23:
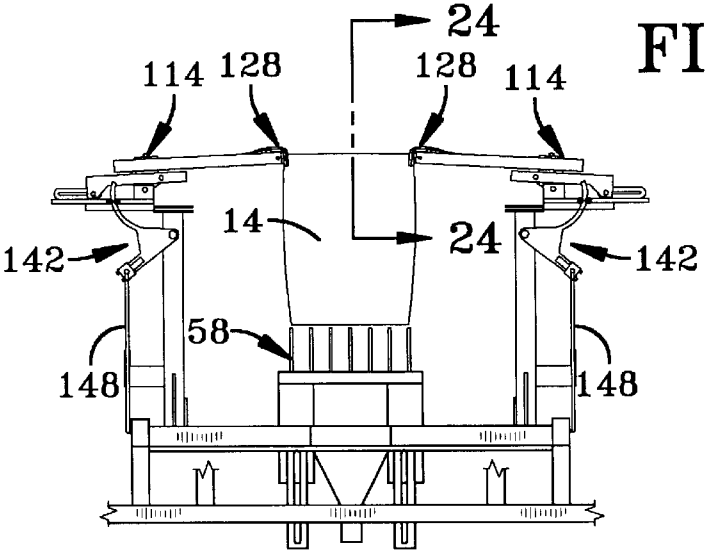
FIG. 23 is a view taken along line 23—23 of FIG. 22.
Figure 22:
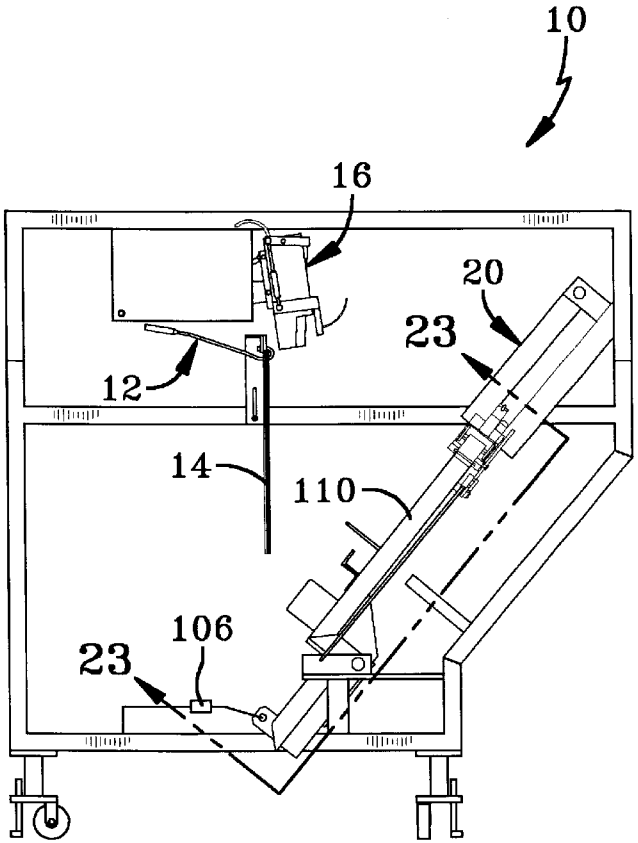
FIG. 22 is a view similar to FIG. 12 showing the grabber assembly in the sixth position.

Sealing apparatus 20 is positioned at sealing station 26 and is configured to seal the top of bag 14 as is well known in the art. Grabber assembly 18 delivers bag 14 to sealing apparatus 20 as shown in FIGS. 22–24. When bag 14 is delivered, sealing apparatus 20 clamps the top of bag 14 between a pair of sealing plates 150 which seal bag 14 by known methods. In some situations, the user of machine 10 desires to draw a vacuum in bag 14 prior to sealing. One problem in the art is that the open top of bag 14 allows air to enter bag 14 as the vacuum is pulled. In order to solve this problem, a flexible pinch pad 152 is positioned above the juncture of plates 150 to hold the top of bag 14 closed while the vacuum is being drawn in bag by air line 134. Immediately after the vacuum is drawn, sealing plates 150 are activated to seal bag 14.

Hand assemblies 126 then release bag 14 and grabber assembly reverts to its original position to receive another bag 14. Sealing apparatus 20 may remove top flange 40 and release bag 14 to conveyor 28.

Figure 13:
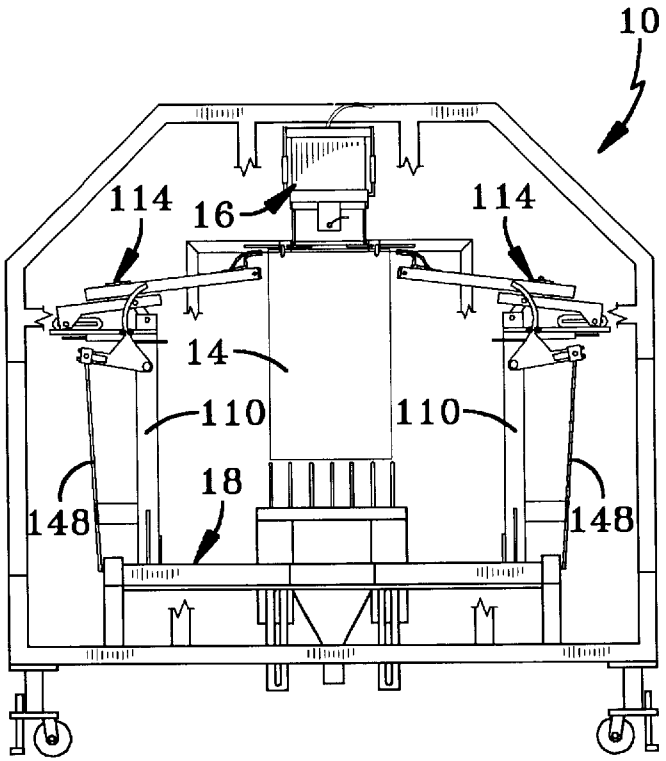
FIG. 13 is a view taken along line 13—13 of FIG. 12.
Figure 12:
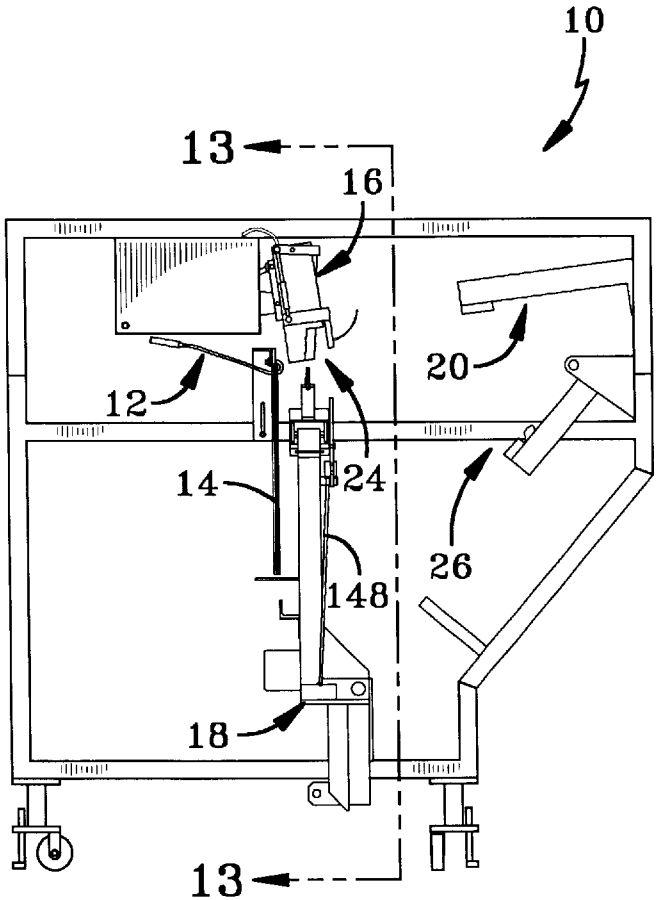
FIG. 12 is a side view showing the grabber assembly in a first position relative to the funnel assembly and the sealing apparatus.

In FIGS. 12 and 13, machine 10 is in an initial ready position with a plurality of bags 14 mounted on bag holder 12. Funnel assembly 16 is in a first position with funnel 60 closed and tilted to a position where it is ready to enter bag 14. Grabber assembly is also in an initial position with grabbers 114 retracted and finger assemblies 128 in the open position.

Figure 15:
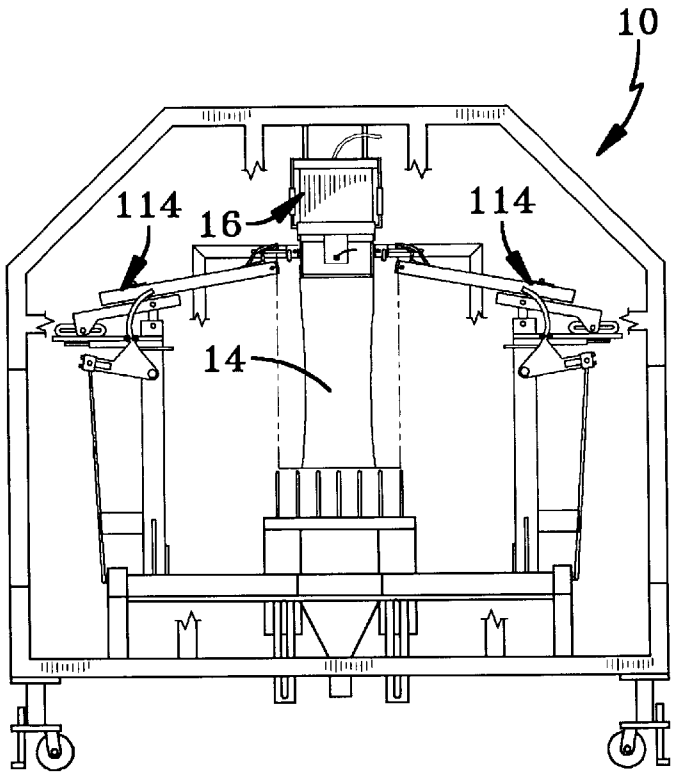
FIG. 15 is a view taken along line 15—15 of FIG. 14.
Figure 14:
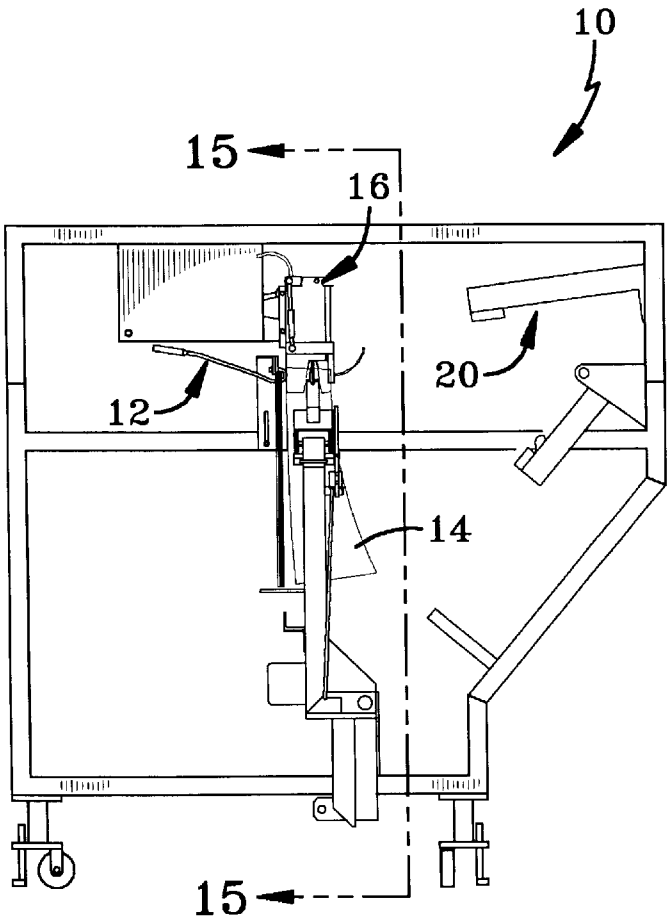
FIG. 14 is a view similar to FIG. 12 showing the grabber assembly in a second position.

FIGS. 14 and 15 depict the next step of the operation where funnel assembly 16 has opened bag 14 and grabbers 114 are moving inwardly to grab the top of the sides of bag 14. This motion is achieved by rotary actuator 120 and drive arm 122. FIG. 15 depicts how hand assemblies 126 move up over the top of bag 14 while moving in toward bag 14.

Figure 19:
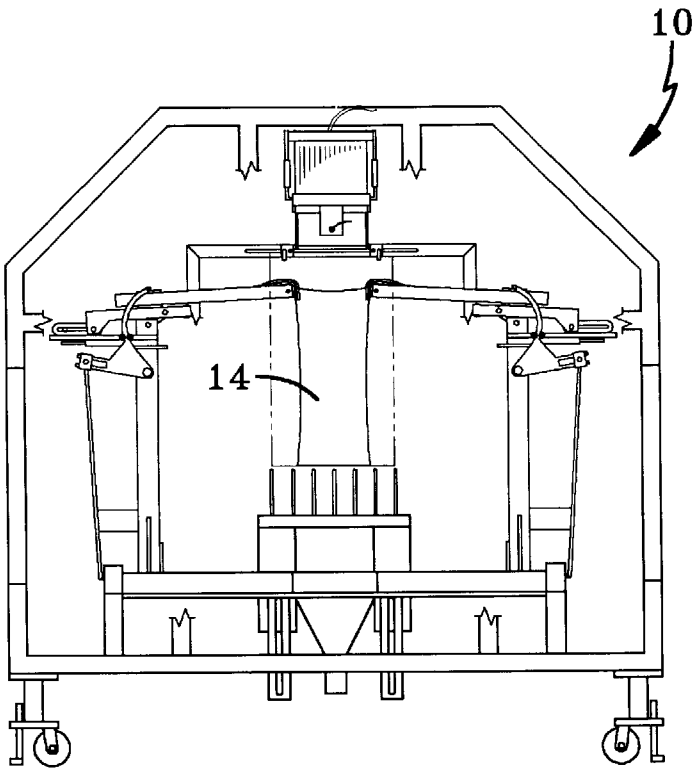
FIG. 19 is a view taken along line 19—19 of FIG. 18.
Figure 18:
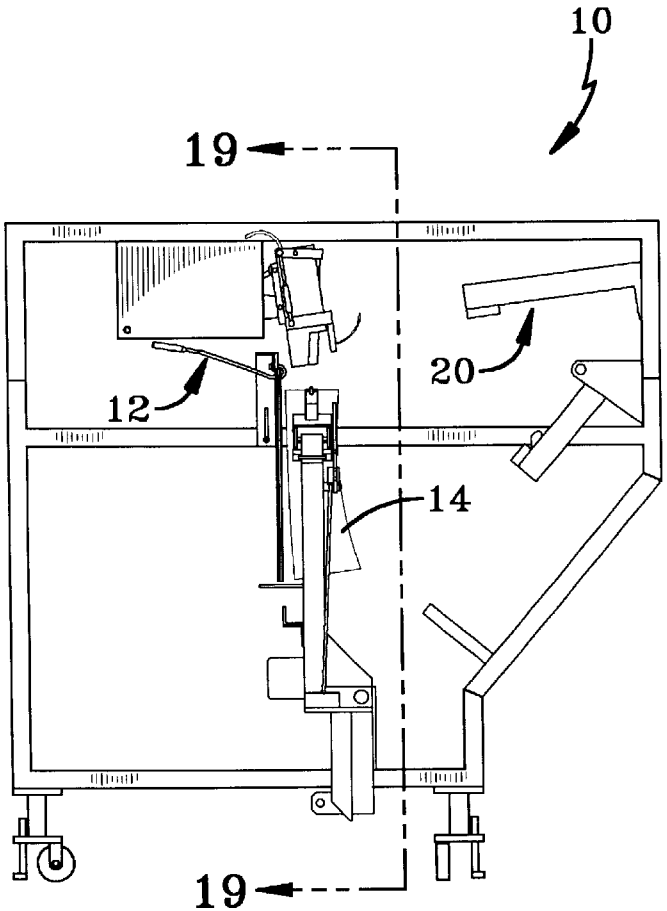
FIG. 18 is a view similar to FIG. 12 showing the grabber assembly in the fourth position.

FIGS. 16 and 17 show hand assemblies 126 moved to their extended positions and finger assemblies 128 moved to the closed position to hold the edges of bag 14. At this position, bag 14 may be loaded. FIGS. 18 and 19 show funnel assembly 16 being removed from bag 14 after bag 14 has been filled. Grabbers 114 and lower support structure 58 now solely support bag 14 in machine 10.

Figure 21:
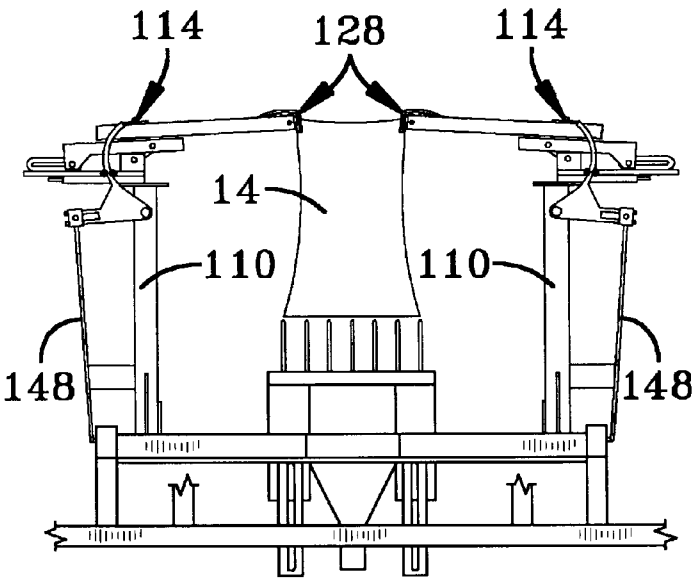
FIG. 21 is a view taken along line 21—21 of FIG. 20.
Figure 20:
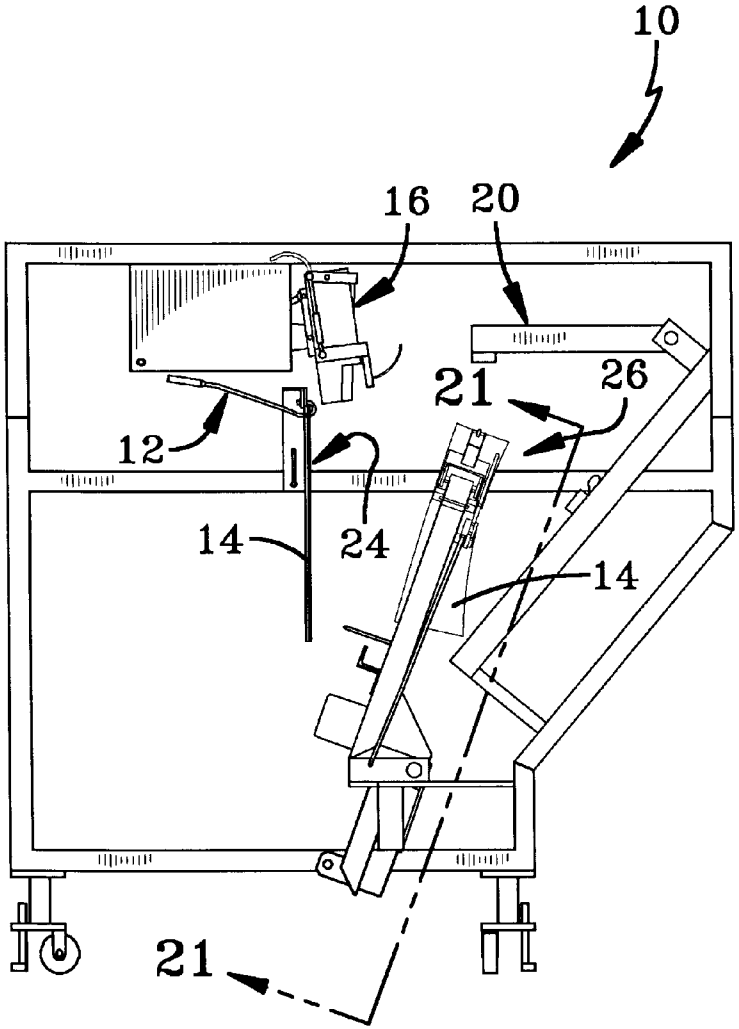
FIG. 20 is a view similar to FIG. 12 showing the grabber assembly in the fifth position.

FIGS. 20 and 21 show bag 14 being moved from filling station 24 toward sealing station 26. As grabber assembly 18 pivots about the axis of drive rod 100, cam rods 148 pull cams 144 down causing grabbers 114 to retract away to from bag 14 and pull the top of bag 14 closed.

FIGS. 22 and 23 show bag 14 received in sealing station 26 with grabbers 114 fully retracted to closed the top of bag 14. Sealing apparatus 20 then closes over bag 14 and seals the top of bag 14. Grabber assembly 18 then releases bag 14 and reverts to the initial position to move another bag 14.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

What is claimed is:

1. A method for filling and sealing a bag with a material, the method comprising the steps of:

(a) providing an empty collapsed bag on a bag holder;

(b) removing the bag from the bag holder with a funnel assembly;

(c) opening the bag with the funnel assembly;

(d) filling the bag with material through the funnel assembly;

(e) grasping the opposed top edges of the bag with a pair of grabber arms;

(f) pulling the grasped top edges of the bag apart;

(g) delivering the bag to a sealing apparatus; and (h) sealing the bag.

2. The method of claim 1, wherein step (b) includes the step of placing the funnel assembly in the opening of the bag and tilting the funnel assembly away from the bag holder to remove the bag from the bag holder.

3. The method of claim 2, further comprising the step of blowing air into the opening of the bag before the funnel assembly is inserted into the opening.

4. The method of claim 1, wherein step (c) includes the step of providing the funnel assembly with first and second halves and moving the first and second halves apart from each other after the funnel is inserted into the opening of the bag.

5. The method of claim 1, wherein step (c) further includes the step of blowing a fluid into the bag to fully open the bag.

6. The method of claim 5, further comprising the step of providing the bag with gussets and opening the gussets when the fluid is blown into the bag.

7. The method of claim 1, wherein step (e) includes the steps of providing a pair of finger assemblies and moving the finger assemblies up, over, and down over the top edges of the bag.

8. The method of claim 7, further comprising the step of moving the finger assemblies away from each other to close the opening of the bag.

9. The method of claim 8, further comprising the step of moving the bag toward the sealing apparatus while the finger assemblies are moving away from each other.

10. The method of claim 9, further comprising the step of providing a fluid line connected to at least one of the finger assemblies.

11. The method of claim 1, wherein step (c) occurs before step (b).

12. A method for filling and sealing a bag with a material, the method comprising the steps of:

(a) providing an empty collapsed bag on a bag holder;

(b) removing the bag from the bag holder with a funnel assembly;

(c) opening the bag with the funnel assembly;

(d) filling the bag with material through the funnel assembly;

(e) delivering the bag to a sealing apparatus; and sealing the bag.

13. The method of claim 12, wherein step (b) includes the step of placing the funnel assembly in the opening of the bag and tilting the funnel assembly away from the bag holder to remove the bag from the bag holder.

14. The method of claim 13, further comprising the step of blowing air into the opening of the bag before the funnel assembly is inserted into the opening.

15. The method of claim 12, wherein step (c) includes the step of providing the funnel assembly with first and second halves and moving the first and second halves apart from each other after the funnel is inserted into the opening of the bag.

16. The method of claim 12, wherein step (c) further includes the step of blowing a fluid into the bag to fully open the bag.

17. The method of claim 16, further comprising the step of providing the bag with gussets and opening the gussets when the fluid is blown into the bag.

18. The method of claim 12, wherein steps (a) and (b) include the steps of providing a bag holder having a body rod connected to a frame member and pulling the bag from the rod without pinching the bag between the rod and the frame member.

19. The method of claim 12, wherein step (c) occurs before step (b).

20. A method of filling a bag with a material and sealing a bag; the method comprising the steps of:

(a) providing an empty collapsed bag on a bag holder;

(b) opening the bag;

(c) filling the bag with material;

(d) grasping the opposed top edges of the bag with a pair of grabber arms;

(e) pulling the grasped top edges of the bag apart;

(f) delivering the bag to a sealing apparatus; and (g) sealing the bag;

wherein step (f) includes the steps of providing a pair of finger assemblies and moving the finger assemblies up, over, and down over the top edges of the bag.

21. The method of claim 20, further comprising the step of moving finger assemblies away from each other to close the opening of the bag.

22. The method of claim 20, further comprising the step of moving the bag toward the sealing apparatus while the finger assemblies are moving away from each other.

23. The method of claim 20, wherein step (e) is being conducted while step (f) is being conducted.

24. A method for filling and sealing a bag with a material, the method comprising the steps of:

(a) providing an empty collapsed bag on a bag holder;

(b) removing the bag from the bag holder with a funnel assembly;

(c) filling the bag with material through the funnel assembly; and (d) sealing the bag.

25. The method of claim 24, wherein step (b) includes the step of placing the funnel assembly in the opening of the bag and moving the funnel assembly away from the bag holder to remove the bag from the bag holder.

26. The method of claim 25, further comprising the step of tilting the funnel assembly away from the bag holder.

27. The method of claim 24, further comprising the step of opening the bag with the funnel assembly.

28. The method of claim 27, further comprising the steps of providing the funnel assembly with first and second halves and moving the first and second halves apart from each other to open the bag with the funnel assembly.

29. The method of claim 24, wherein steps (a) and (b) include the steps of providing a bag holder having a body rod connected to a frame member and pulling the bag from the rod without pinching the bag between the rod and the frame member.

30. A method of filling a bag with a material and sealing a bag; the method comprising the steps of:

(a) providing an empty collapsed bag on a bag holder;

(b) filling the bag with material;

(c) grasping the opposed top edges of the bag with a pair of finger assemblies that move inwardly and down to grasp the top edges of the bag, the motion being with respect to the bag;

(d) delivering the bag to a sealing apparatus; and (e) sealing the bag.

31. The method of claim 30, further comprising the step of moving finger assemblies away from each other to close the opening of the bag.

32. The method of claim 30, further comprising the step of moving the bag toward the sealing apparatus while the finger assemblies are moving away from each other.

* * * * *